US006918426B1

(12) United States Patent
Westby

(10) Patent No.: US 6,918,426 B1
(45) Date of Patent: Jul. 19, 2005

(54) WINDOW INSULATING SYSTEM

(76) Inventor: David A. Westby, 966 Williamsburg Park, Barrington, IL (US) 60010

( * ) Notice: Subject to any disclaimer, the term of this patent is extended or adjusted under 35 U.S.C. 154(b) by 36 days.

(21) Appl. No.: 10/417,480

(22) Filed: Apr. 17, 2003

Related U.S. Application Data

(63) Continuation-in-part of application No. 10/054,371, filed on Jan. 22, 2002, now abandoned, which is a continuation-in-part of application No. 09/587,433, filed on Jun. 5, 2000, now abandoned.

(51) Int. Cl.[7] ..... E06B 9/00
(52) U.S. Cl. ..... 160/368.1; 52/203; 428/41
(58) Field of Search ..... 160/368.1, 354, 160/90, 238, 266, 327

(56) References Cited

U.S. PATENT DOCUMENTS 1,711,463 A * 4/1929 Paul ..... 24/457
2,612,947 A 10/1952 Jenks ..... 160/40
3,511,365 A * 5/1970 Dow ..... 206/390
3,808,610 A * 5/1974 Mortensen ..... 4/558
4,079,772 A * 3/1978 Klaenhammer et al. . 160/268.1
4,419,982 A * 12/1983 Eckels ..... 126/625
4,749,222 A * 6/1988 Idland ..... 296/152
4,993,471 A 2/1991 Golden
5,025,848 A * 6/1991 Prochaska ..... 160/368.1
5,553,654 A * 9/1996 Wu ..... 160/370.21
5,570,734 A 11/1996 Wu ..... 160/370.21
5,622,215 A * 4/1997 Lien ..... 160/370.21
5,850,864 A * 12/1998 Decker ..... 160/268.1

* cited by examiner

*Primary Examiner*—Blair M. Johnson
(74) *Attorney, Agent, or Firm*—Thomas R. Vigil; Welsh & Katz, Ltd.

(57) ABSTRACT

The window insulating system comprises a mesh scrim sized to fit substantially completely within a window frame and substantially over all of an inside surface of a window pane and positioning and holding means for positioning and holding said mesh scrim closely adjacent the inside surface of the window pane without adhesively fixing said mesh scrim to the window pane or to the window frame with the distance between the mesh scrim and the inside surface of the window pane being between approximately 0.005 inch and approximately 0.050 inch.

20 Claims, 4 Drawing Sheets

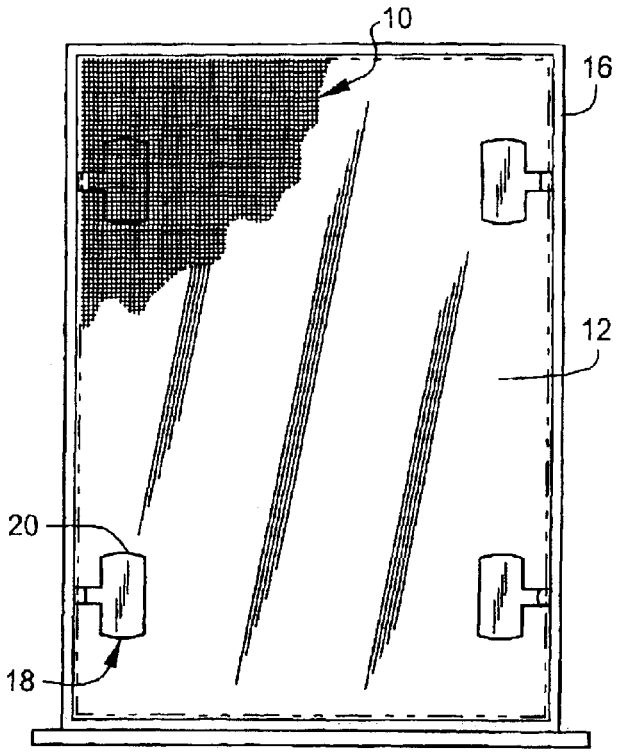
FIG. 1
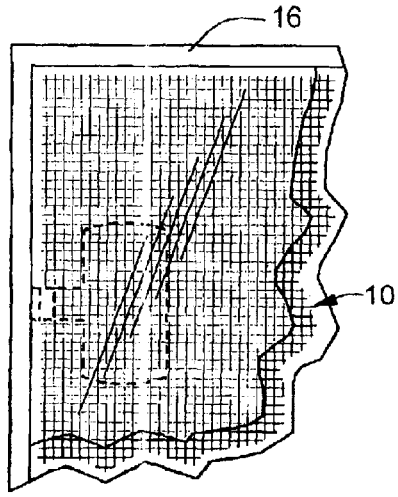
FIG. 2
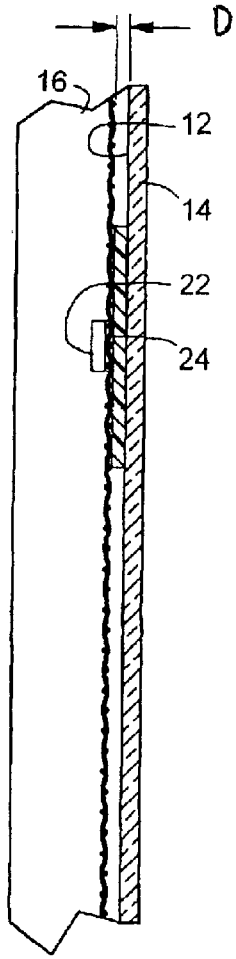
FIG. 3
FIG. 4
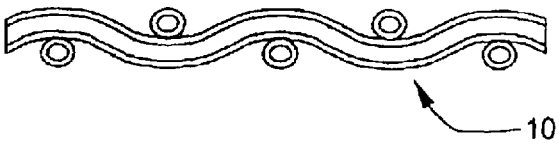
FIG. 5
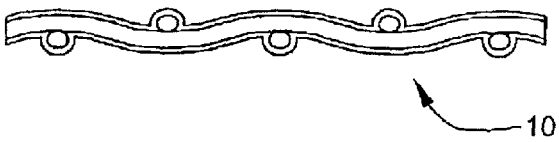

WINDOW INSULATING SYSTEM

CROSS-REFERENCE TO RELATED APPLICATIONS

This application is a continuation-in-part of U.S. application Ser. No. 10/054,371, filed Jan. 22, 2002 abandon, for WINDOW INSULATING SYSTEM, which is a continuation-in-part of U.S. application Ser. No. 09/587,433, filed Jun. 5, 2000 abandon for WINDOW INSULATION SYSTEM.

BACKGROUND OF THE INVENTION

1. Field of the Invention

The present invention is directed to a system for insulating a glass pane in a window or door to keep heat in a room or to prevent heating of a room from outside heat and rays of the sun or to prevent heat or cold from escaping from a room through a glass window or wall. More specifically, the insulating system is directed to a mesh scrim and positioning and holding structure for positioning and holding the mesh scrim closely adjacent an inner surface of a window pane by a surface to surface sticking of a plastic pad, that is mounted on the mesh scrim, to a an inside surface of the glass pane or by mounting the mesh scrim on a roller at the top of the window or wall and training the mesh scrim to move closely adjacent the inside surface of the glass pane when the roller is rotated.

2. Description of the Prior Art

Heretofore various insulating systems for a glass window pane have been proposed including double pane windows, inside and outside storm windows, shades, drapes curtains and mesh scrims.

Examples of analogous and non-analogous prior art window covering structures are disclosed in the following analogous and non-analogous U.S. patents:

| U.S. Pat. No. | PATENTEE |
|---|---|
| 1,711,463 | Paul |
| 3,808,610 | Mortensen |
| 3,834,352 | Gervis |
| 3,924,893 | Ferrara |
| 4,073,998 | O'Conner |
| 4,079,772 | Klaenhammer, et al. |
| 4,098,318 | Ruegesegger |
| 4,103,728 | Burdette, et al. |
| 4,149,982 | Eckels |
| 4,182,088 | Ball |
| 4,272,934 | Cowden, et al. |
| 4,359,792 | Dale |
| 4,399,640 | Porter |
| 4,416,096 | Shuster, et al. |
| 4,436,137 | Charles |
| 4,454,691 | Mitchell |
| 4,486,990 | Bauch |
| 4,514,945 | Menchetti, et al. |
| 4,562,675 | Baigis, Jr. |
| 4,658,555 | Steiner |
| 4,699,842 | Jorgenssen, et al. |
| 4,971,028 | Fagan |
| 4,972,896 | Roberts |
| 5,025,848 | Prochaska |
| 5,669,191 | Weaver |
| 5,850,864 | Decker |
| 5,964,437 | Belokin, et al. |
| 6,053,356 | Emoff, et al. |
| 6,148,867 | Matthews, et al. |

However, in the prior art hanging or fixing of barriers adjacent a window, e.g. a storm window structure, a shade, a curtain or a mesh scrim type window covering, such barriers are hung or fixed at a distance away from the window pane, typically one inch or more. Also, the barrier, such as a sheet of plastic was often fixed to a window frame with an adhesive.

As will be described in greater hereinafter, applicant has discovered that the insulating effectiveness of a mesh scrim is greatly increased by making the distance between the mesh scrim and the inner surface of the glass window pane as small as possible, i.e., between 0.005 and 0.050 inch, to inhibit, if not completely block the flow of air between the window pane and the mesh scrim thereby to insulate better the window pane. The insulating system of the present invention achieves this close spacing without the use of an adhesive between a glass window pane and plastic clips fixed to the mesh scrim and does not fix the mesh scrim to a window frame with an adhesive. Rather the mesh scrim of the invention is releasably attached to the inside surface of a glass window pane by the surface adhesion of several pad portions of several plastic clips that are secured to the mesh scrim or by training the mesh scrim to hang down directly against the inner surface of the glass window frame. The insulating effect is further enhanced by coloring the mesh scrim with a light color, such as the color white.

SUMMARY OF THE INVENTION

According to the present invention, there is provided a window insulating system comprising a mesh scrim sized to fit substantially completely within a window frame and substantially over all of an inside surface of a window pane and positioning and holding structure for positioning and holding the mesh scrim closely adjacent the inside surface of the window pane without fixing the mesh scrim with an adhesive to the window pane or to the window frame and with the distance between the mesh scrim and the inside surface of the window pane being between 0.005 inch and approximately 0.050 inch.

In one embodiment, the positioning and holding structure comprises at least two plastic clips each having a tab portion, a pad portion which holds the mesh scrim by a surface to surface sticking of the plastic pad to the inside surface of the window pane and a U-shaped connecting portion. In this embodiment, the plastic pad sticks to or adsorbs (such as by a surface suction or adsorbtion) to a glass window pane in a releasable manner, much like a plastic refrigerator door sticker which is well know in the art. This phenomena is sometimes referred to as adsorbing, surface adhesion, static cling, or simply a surface to surface sticking of a plastic material of its own volition to a metal, plastic or glass surface, which is well known in the art. It is inherent that the plastic clips, which can be fixed to the mesh scrim with an adhesive, will adhere to a glass window pane, by surface adhesion or by a surface to surface releasable sticking of the plastic pad portion to a glass surface, or by whatever one wants to call it.

In another embodiment, the positioning and holding structure comprises a roller assembly including a roller mounted at an upper end of a window or wall, an upper edge of the mesh scrim being attached to the roller, and a guide bar or roller is positioned adjacent an upper edge of the window pane for guiding the mesh scrim downwardly closely adjacent the inside surface of the window pane.

Recently, an improved window insulating system has been developed which includes a sheet of white plastic mesh scrim, 0.030–0.050 inch laminated (such as with an adhesive) to a thin, 0.005–0.010 thick (preferably 0.007 inch thick) clear PVC sheet. The side of the lamination having the PVC sheet is placed against the inside surface of a window pane and held to the window pane by surface adhesion, adsorbtion, static cling, or by whatever the sticking of a plastic surface to glass surface is called. A tab is fixed to the laminated sheets to enable one easily to pull the laminated sheets off of a window pane.

BRIEF DESCRIPTION OF THE SEVERAL VIEWS OF THE DRAWINGS

FIG. 1 is an elevational view of a window pane having a scrim of the present invention fixed thereto by surface adhesion to the window pane of four plastic clips to the window pane, the clips being adhered to the mesh scrim by an adhesive, with portions of the mesh scrim shown broken away.

FIG. 2 is a large corner view of the window and mesh scrim shown in FIG. 1.

FIG. 3 is an elevational sectional view of part of the window frame shown in FIG. 1.

FIG. 4 is a sectional view of one form of mesh scrim wherein the strands of the mesh scrim are first coated with a plastic coating prior to weaving.

FIG. 5 is a sectional view of another form of mesh scrim wherein the strands of the mesh scrim are first woven and then coated with a plastic coating.

DETAILED DESCRIPTION OF THE INVENTION

Figure 6:
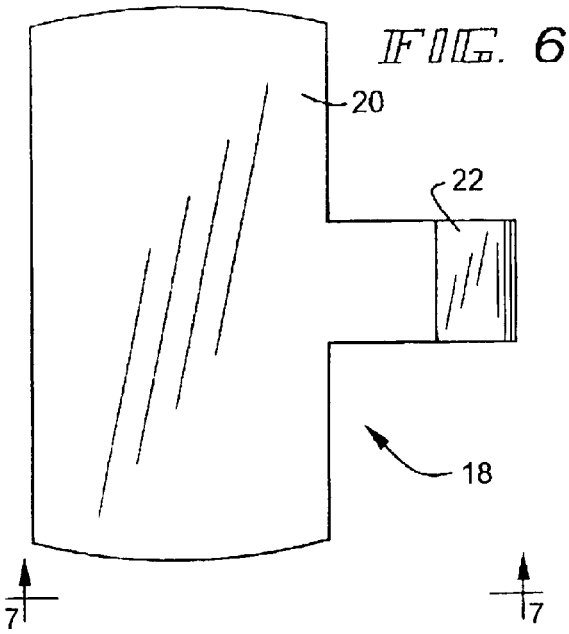
FIG. 6 is a plan view of the tab shown in FIG. 1.

Referring now to the drawings in greater detail, there is illustrated in FIGS. 1, 2 and 3 a mesh scrim 10 which is woven from strands of synthetic or natural fiber and which are coated separately prior to weaving, as shown in FIG. 4 or coated after weaving, as shown in FIG. 5.

The mesh scrim 10 can be obtained from Twitchell Corp. of Dothan Ala., under the trademark TEXTILENE (coated before weaving, preferably with a white coating) or from Snyder Manufacturing, Inc., product no. PCS 1018, a PVC coated scrim mesh, (coated after weaving, preferably with a white coating). In an empirical test, it has been found through thermal imaging of the mesh scrim 10 on a window pane relative to a mini-blind positioned a short distance from the window pane that the mesh scrim provides better insulation and that a mesh scrim which is coated after weaving provided the best insulation. The mesh size is typically defined as 18×14, 840/1000 denier (Snyder) to a woven fabric using 0.025 inch diameter vinyl-coated 1000 denier polyester core yarn (Twitchell). The Snyder scrim mesh has between 0.015 and 0.025 inch rectangular holes therein. Also the mesh scrim was between 0.030 and 0.050 inch thick, typically about 0.040 inch thick.

As shown, the mesh scrim 10 is cut to fit as closely and precisely as possible over and adjacent the entire inner surface 12 of a window pane 14 (FIG. 3). Typical sizes for the mesh scrim 10 are: 30"×74", 36"×74", 48"×74" and 60"×74" and custom order sizes.

Empirical tests and thermal imaging have brought to light that the best possible insulating value is obtained with the mesh scrim 10 by covering the entire inner surface 12 of the window pane 14. Thus, while mesh scrims have been used as curtains and shades, their insulating value is limited by the flow or convection of air between the mesh scrim and the window.

To provide a close fit of the mesh scrim 10 and adjacent the inner surface 12, it is first cut to the precise dimensions of a window frame 16 within which the mesh scrim is to be mounted. Then, through the use of specially designed plastic clips 18 which have a surface adhesion to a glass surface, the mesh scrim 10 is releasably fixed or adhered by the plastic clips 18 to an inner surface of a window pane. The plastic clips 18 are made as thin as possible, e.g., 0.040–0.050 inch thick from PVC which has a surface adhesion to a glass surface.

Figure 7:
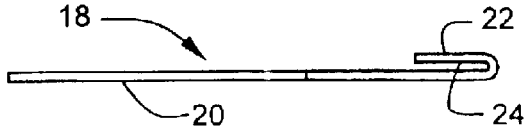
FIG. 7 is an edge view of the tab shown in FIG. 6 and is taken along line 7—7 of FIG. 6.

In one preferred embodiment, and as shown in FIGS. 6 and 7, each clip 18 has a generally U-shape with a large pad portion 20 and a smaller tab portion 22 connected by a U-shaped connecting portion (FIG. 3). In one preferred embodiment the pad portion 20 has an areal extent of approximately 1.25" by 3" areal extent. The size of the pad portion 20 can vary in size depending on the size of the mesh scrim 10 with which it is used.

In one preferred embodiment, the tab portion 22 has an areal extent of approximately 0.375" by 0.375" and an adhesive is applied between the surface of the mesh scrim 10 and an inner surface 24 of the tab portion 22 to hold the plastic clip 18 to the mesh scrim 10.

The thickness of the plastic clips 18 should be as small as possible and one thickness which has provided the plastic clips 18 with sufficient strength and holding power is 0.040 inch, ±0.005 inch.

Figure 8:
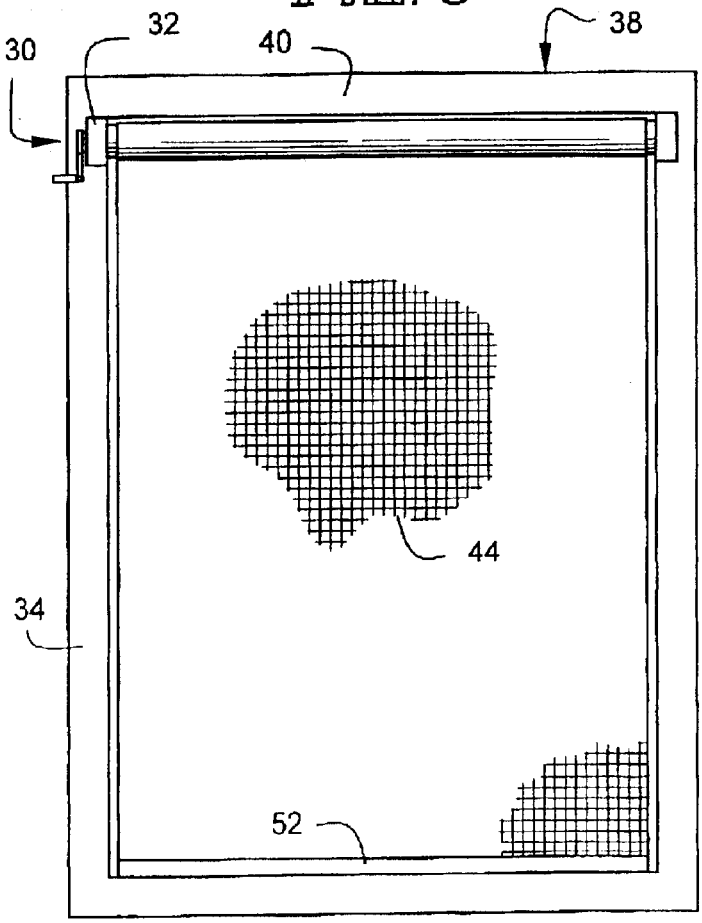
FIG. 8 is a plan view of a window with a roller assembly mounted at the top of the window for guiding a mesh scrim over an inner surface of a window pane.
Figure 9:
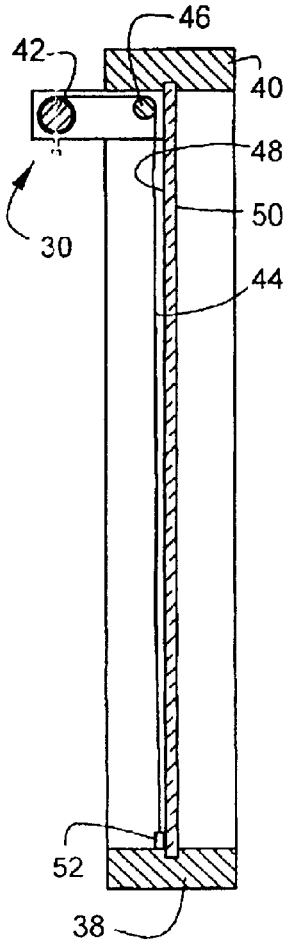
FIG. 9 is a sectional view through the window pane, roller assembly and mesh scrim shown in FIG. 8.

Referring now to FIGS. 8 and 9, there is illustrated therein, an insulating system 30 which includes a roller 32 mounted between upright portions 34 and 36 of a window frame 38 adjacent a top portion 40 of the frame 38. An upper end 42 of a mesh scrim 44 is fixed to the roller 32 and then is trained over a guide roller or bar 46 which is positioned closely adjacent an inner surface 48 of a glass window pane 50.

With the system 30, the mesh scrim can be held closely adjacent the inner surface 48 of the window pane 50, and as close as a distance D=0.005 inch.

To ensure a close placement of the mesh scrim 44 adjacent or against the inner surface 48 of the window pane 50, the system 30 further includes a bar weight 52 mounted to the lower margin of the mesh scrim 44.

Figure 10:
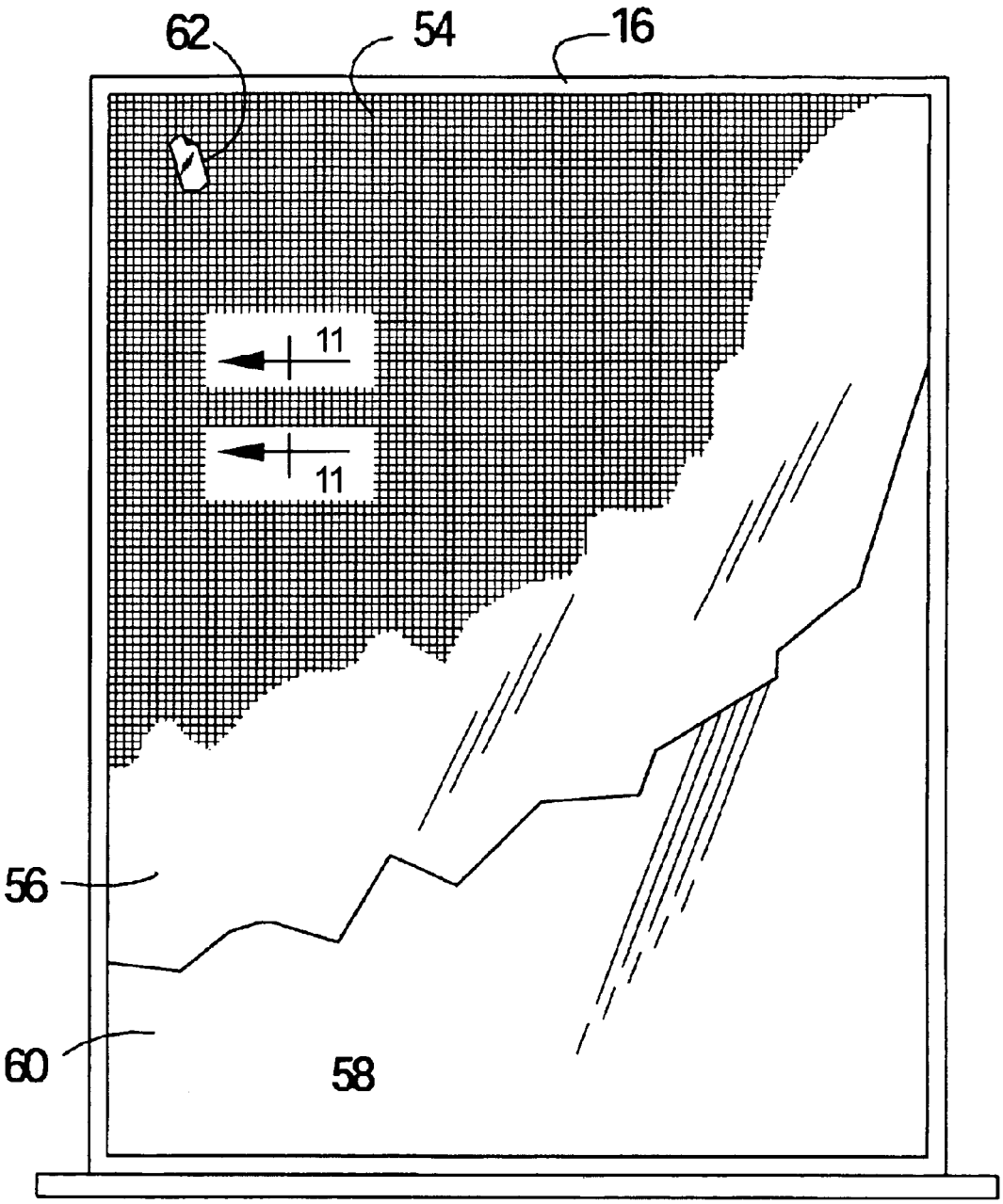
FIG. 10 is a plan view of another window insulating system or assembly including a mesh scrim releasably fixed to the inside surface of a window pane.
Figure 11:
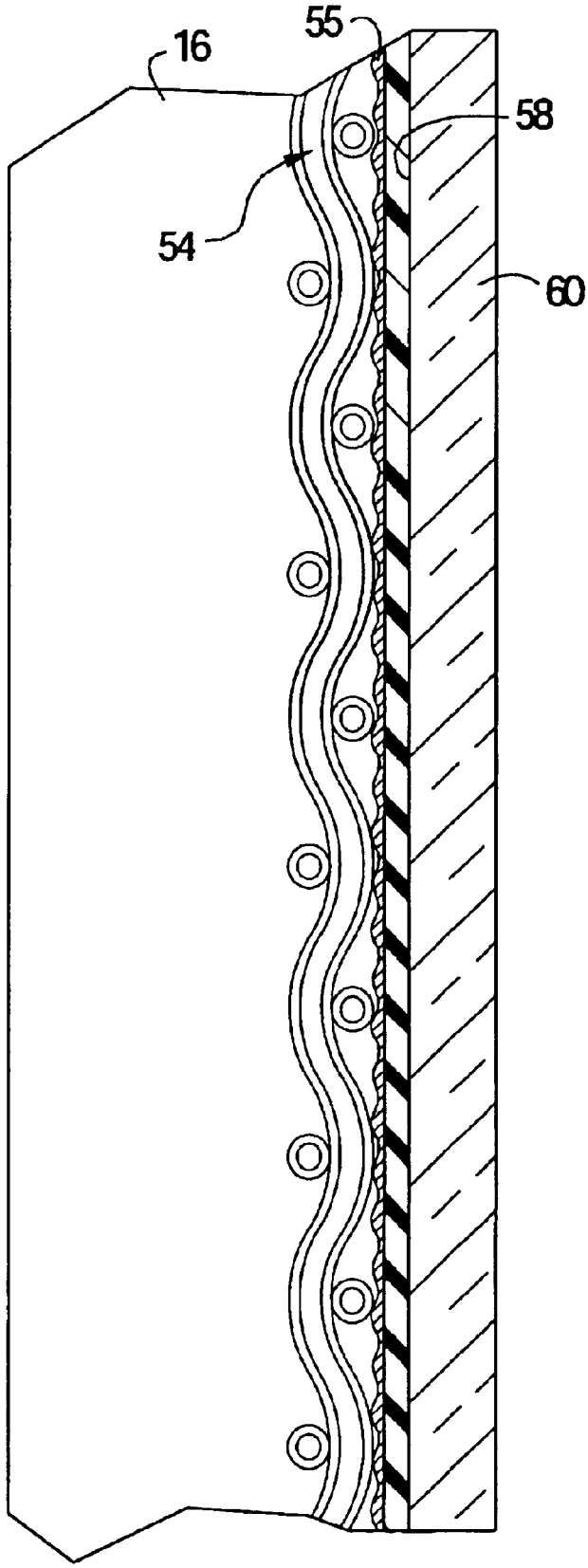
FIG. 11 is an enlarged sectional view of the window insulating assembly shown in FIG. 10 and is taken along line 11—11 of FIG. 10.

Another window insulating system is shown in FIGS. 10 and 11 and includes a sheet of white plastic mesh scrim 54, 0.030–0.050 inch which is laminated (such as with an adhesive 55 (FIG. 11)) to a thin, 0.005–0.010 thick (preferably 0.007 inch thick) clear PVC sheet 56. The side of the lamination having the PVC sheet is placed against the inside surface 58 of a window pane 60 and held to the window pane by surface adhesion, adsorbtion, static cling, or by whatever the sticking of a plastic surface to glass surface is called. A tab 62 is fixed to the laminated sheets 54 and 56 to enable one easily to pull the laminated sheets off of a window pane 60.

From the foregoing description, it will be understood that the insulating system 8 or 30 of the present invention provides a number of advantages, some of which have been describe above and others of which are inherent in the invention. Also, modifications can be made to the insulating system 8 or 30 of the present invention without departing from the teachings of the invention. For example, only a pad portion of plastic having an adhesive on one side and a flat planar surface on the other side can be attached by the adhesive to the mesh scrim and then the flat planar surface is pressed against the inner surface of a window pane to attach the mesh scrim to the window pane by surface adhesion. In this way, the distance between the mesh scrim and the inner surface of the window pane can be further reduced. However, it is difficult to remove the pad portions from a window. Nonetheless, this modified system may be preferred where it is not intended to remove the mesh scrim in order to see fully through the window.

Accordingly, the insulating system of the present invention is only to be limited as necessitated by the accompanying claims.

I claim:

1. A window insulating assembly comprising a window pane in a window frame, a mesh scrim sized to fit substantially completely within said window frame and substantially over all of an inside surface of said window pane and fixing and holding structure for releasably fixing and holding said mesh scrim closely adjacent the inside surface of said window pane without fixing said mesh scrim with an adhesive to said window pane or to said window frame and with the distance between the mesh scrim and the inside surface of said window pane being 0.040+/−0.005 inch.

2. The window insulating system of claim 1 wherein openings in said mesh are rectangular with each side of the rectangle being between approximately 0.015 inch and 0.025 inch.

3. The window insulating system of claim 1 wherein said mesh scrim is made of coated fibers which are woven to form said mesh.

4. The window insulating system of claim 3 wherein said coating is colored white.

5. The window insulating system of claim 1 wherein said mesh scrim is made of woven fibers which are first woven and then coated with a plastic.

6. The window insulating system of claim 5 wherein said plastic coating is colored white.

7. A window insulating system comprising a mesh scrim sized to fit substantially completely within a window frame and substantially over all of an inside surface of a window pane and clinging, fixing and holding structure for releasably fixing and holding said mesh scrim closely adjacent the inside surface of the window pane without fixing said mesh scrim with an adhesive to the window pane or to the window frame and with the distance between the mesh scrim and the inside surface of the window pane being 0.040+/−0.005 inch, said clinging, fixing and holding structure comprising at least four plastic clips each having a tab portion positionable on an outside surface of the mesh scrim, a pad portion which is positioned on an inside surface of the mesh scrim and that is adapted to hold the mesh scrim by a releasable, surface to surface sticking of the plastic pad to the inside surface of the window pane and a U-shaped connecting portion between the tab portion and the pad portion.

8. A window insulating assembly comprising a window pane in a window frame, a mesh scrim sized to fit substantially completely within said window frame and substantially over all of an inside surface of said window pane and positioning and holding structure for positioning and holding said mesh scrim closely adjacent the inside surface of said window pane without fixing said mesh scrim with an adhesive to said window pane or to said window frame and with the distance between said mesh scrim and the inside surface of said window pane being approximately 0.005 inch and said positioning and holding structure comprising a roller assembly mounted adjacent the top of a said window frame and including a roller, an upper edge of said mesh scrim being attached to said roller, and a guide bar adjacent an upper edge of said window pane for guiding said mesh scrim downwardly closely adjacent the inside surface of said window pane.

9. The window insulating assembly of claim 8 including a weight attached to a bottom edge of said mesh scrim for holding said mesh scrim in a generally vertical position adjacent the inside surface of said window pane.

10. A window insulating assembly comprising a window pane in a window frame, a mesh scrim sized to fit substantially completely within said window frame and substantially over all of an inside surface of said window pane and fixing and holding structure for releasably fixing and holding said mesh scrim closely adjacent the inside surface of said window pane without fixing said mesh scrim with an adhesive to said window pane or to said window frame and with the distance between said mesh scrim and the inside surface of said window pane being approximately 0.040 inch ±0.005 inch.

11. A window insulating system comprising a mesh scrim sized to fit substantially completely within a window frame and substantially over all of an inside surface of a window pane and clinging, fixing and holding structure for releasably fixing and holding said mesh scrim closely adjacent the inside surface of the window pane without fixing said mesh scrim with an adhesive to the window pane or to the window frame and with the distance between the mesh scrim and the inside surface of the window pane being 0.040 inch ±0.005 inch said clinging, fixing and holding structure comprising at least four plastic clips each having a tab portion positionable on an outside surface of the mesh scrim, a pad portion which is positioned on an inside surface of the mesh scrim and which holds the mesh scrim by a releasable, surface to surface sticking of the plastic pad to the inside surface of the window pane and a U-shaped connecting portion between the tab portion and the pad portion.

12. The window insulating system of claim 11 wherein said tab portion is approximately 0.375 inch by 0.375 inch.

13. The window insulating system of claim 11 wherein said pad portion has a thickness of approximately 0.040 inch ±0.005 inch.

14. The window insulating system of claim 11 wherein said at least four plastic clips are made of PVC.

15. A window insulating system assembly comprising a window pane in a window frame, a mesh scrim sized to fit substantially completely within said window frame and substantially over all of an inside surface of a said window pane and fixing and holding structure for releasably fixing and holding said mesh scrim closely adjacent the inside surface of said window pane without fixing said mesh scrim with an adhesive to said window pane or to said window frame and with the distance between said mesh scrim and the inside surface of said window pane being approximately 0.005 inch.

16. A window insulating system comprising a window pane in a window frame and having an inner surface and an outer surface, a laminated mesh scrim comprising a plastic mesh scrim and a thin sheet of one of clear, translucent or tinted plastic material laminated thereto, the laminated mesh scrim being sized to fit substantially completely within said window frame and substantially over all of said inside surface of said window pane, the plastic sheet having a thickness between 0.005 and 0.010 inch and defining clinging, fixing and holding structure for releasably fixing and holding said mesh scrim at said inside surface of said window pane by surface adhesion, adsorbtion or static cling, without fixing said mesh scrim with an adhesive to said window pane or to said window frame and with the distance between the mesh scrim and the inside surface of the window pane being between 0.005 inch and 0.010 inch.

17. The window insulating system of claim 16 wherein said thin plastic sheet is made of PVC.

18. The window insulating system of claim 16 wherein said thin plastic sheet has a thickness of approximately 0.007 inch.

19. The window insulating system of claim 16 including at least one pull tab fixed to the laminated mesh screen for facilitating the pulling of the laminated mesh screen away from a window pane.

20. The window insulating system of claim 16 wherein said mesh screen is colored white.

* * * * *